United States Patent [19]

Mohrbach

[11] 4,011,646

[45] Mar. 15, 1977

[54] APPARATUS FOR ATTACHING FLEXIBLE PARTS AND/OR INNERSOLES WITH JOINT SPRINGS THROUGH RIVETING

[75] Inventor: Hans Mohrbach, Rieschweiler, Pfalz, Germany

[73] Assignee: Ernst Mohrbach KG, Germany

[22] Filed: Oct. 15, 1975

[21] Appl. No.: 622,680

[30] Foreign Application Priority Data

Oct. 26, 1974 Germany ..... 2450957

[52] U.S. Cl. ..... 29/818; 29/788

[51] Int. Cl.[2] ..... B23P 19/04; B23Q 7/10

[58] Field of Search ..... 29/211 D, 208 D, 208 R, 29/211 R, 243.53

[56] References Cited

UNITED STATES PATENTS

| | | | |
|---|---|---|---|
| 1,493,480 | 5/1924 | De Tour | 29/211 R X |
| 2,456,125 | 12/1948 | Drew | 29/243.53 X |
| 2,920,783 | 1/1960 | Kipp et al. | 29/243.53 |
| 3,257,715 | 6/1966 | Luther | 29/211 D X |

*Primary Examiner*—Victor A. DiPalma
*Attorney, Agent, or Firm*—Frank L. Durr; Orville N. Greene

[57] ABSTRACT

An apparatus which is suitable for automatic operation is provided for riveting bowed leaf-like springs to flexible bodies, e.g. for riveting shanks to innersoles. Two riveting devices are included in the apparatus for simultaneously riveting the two ends of the shank to the flexible body. This means for feeding the flexible body to riveting position and the means for feeding rivets to the riveting devices are more or less conventional. The shanks to be united to innersoles are fed one at a time, from a pair of magazines holding a stack of shanks at the ends, to a pair of guide bars containing matching grooves, pushed along the grooves by a pusher means, which shanks at the end of the grooves arrive at the riveting position. At the end of the grooves, the lower ends of the latter are in the form of leaf springs so that the shank to be united can be snapped out of the groove. The guide bars are mounted so as to be pivoted downwardly against the action of a spring. As the riveting devices press against the shank and flexible part to be united, these parts are firmly retained in their proper position as the shank is snapped out of the groove and the riveting action is finished.

4 Claims, 6 Drawing Figures

APPARATUS FOR ATTACHING FLEXIBLE PARTS AND/OR INNERSOLES WITH JOINT SPRINGS THROUGH RIVETING

The invention concerns an apparatus for attaching flexible parts and/or innersoles to shanks through riveting. The simplest devices for carrying out this process in the manufacture of shoes consists of a simple tool with which the rivets are introduced in the area of the front and back ends of the shank and thereby a connection between the flexible part or the innersole with the applied shank is established. A further development of this apparatus provides two riveting tools which introduce both rivets in one operation. The shanks are usually of metal, but may be made of plastic or any relatively stiff and/or springy material.

There are also known stacking, separation, feeding and supplying apparatuses for the different elements, so as to provide, for example, innersoles or the like, to a further treating apparatus. Corresponding apparatus for the feeding of rivets to riveting tools are also known.

This invention is based on the problem of making an apparatus of the above mentioned type, with the aid of which, through a single release procedure, there always results a bringing together of an innersole or similar flexible part, with a shank and a riveting of the shank with the flexible part or the innersole. While, as already mentioned, that part of the problem connected with the delivery of the innersole or other part, the arrangement of the riveting devices, the delivery of the rivets has been solved, one has not succeeded, until now, to also solve the problem of delivering the shank. In this connection, the prestressed arch of the shank plays a roll, while prestressing must at least partly be overcome during the riveting, and which makes it difficult to always guarantee the uniform, safe delivery and holding of the shank during the entire riveting process. Beyond that, the apparatus must also be so constructed that all conceivable forms and sizes of innersoles, flexible parts and shanks can be handled.

The invention solves the problems set forth through an apparatus for connecting flexible parts and/or innersoles with shanks by riveting, which has a stack and supply arrangement for the innersoles and/or flexible pieces, as well as a store and supply arrangement for the rivets and two riveting tools for connecting and riveting both work pieces, in which a means for stacking and delivering the shanks is provided, which has, independently controlled, a magazine for holding shanks in the form of a stack, hammers movable in the long direction of the shanks for separating one shank at a time, a shover for delivering the separated shank to the area of the riveting tools, where at the end of the feeding movement of the pushed shank, leaf springs for holding the flexible shank in the riveting area and control means for the release thereof are provided, the individual feeding and processing steps being reciprocally independent of one another, whereby the said part-carrying means, in the range of the riveting tool, is depressible against the restoring force of a spring.

The feeding slider for the shank can advantageously be combined with a movable bar, also movable in the feed direction, which guarantees an accurate definition of both end positions of the slider. The leaf springs extending in the plane of the feed direction are preferably arched somewhat downwards at their edge regions, on the uptake ends.

With this apparatus, first of all, an unobjectionable separation of a single shank and likewise unobjectionable feed to the area of the riveting tool is obtained. Next, the shank is held fast in its working position by the two leaf springs and under the influence of the downwardly moving riveting tool, whereby the holding is maintained through the leaf springs until the tension of the restoring spring is overcome. At this instant, the shank is, however, already held fast against the part with which it is to be connected under the influence of both riveting tools which have been pressed to overcome the characteristic force of the restoring spring, so that a shifting of the parts to be combined is excluded. This indicates, however, that here for the first time, conditions are provided, without manual skill, where it is possible to obtain a completely exact riveting of innersoles or flexible pieces with the coordinated shanks in a quick sequence of operations and in large amounts. In addition to this, the spring properties of the shank react in an elegant manner, which properties, however, up until now, have been an obstacle for a controlled fast operation.

If the different parts of the apparatus, namely, the two rivet tools, the guide and holder for the innersole, or the piece to be joined and the guide and holder for the shank are made adjustable, then all important conceivable forms and sizes of the parts to be worked on can be accommodated.

Further features of the invention and details through which other obtained advantages result, are apparent from the following description when read in connection with the accompaying drawing illustrating a non-limiting example of an apparatus made according to the invention.

Figure 1:
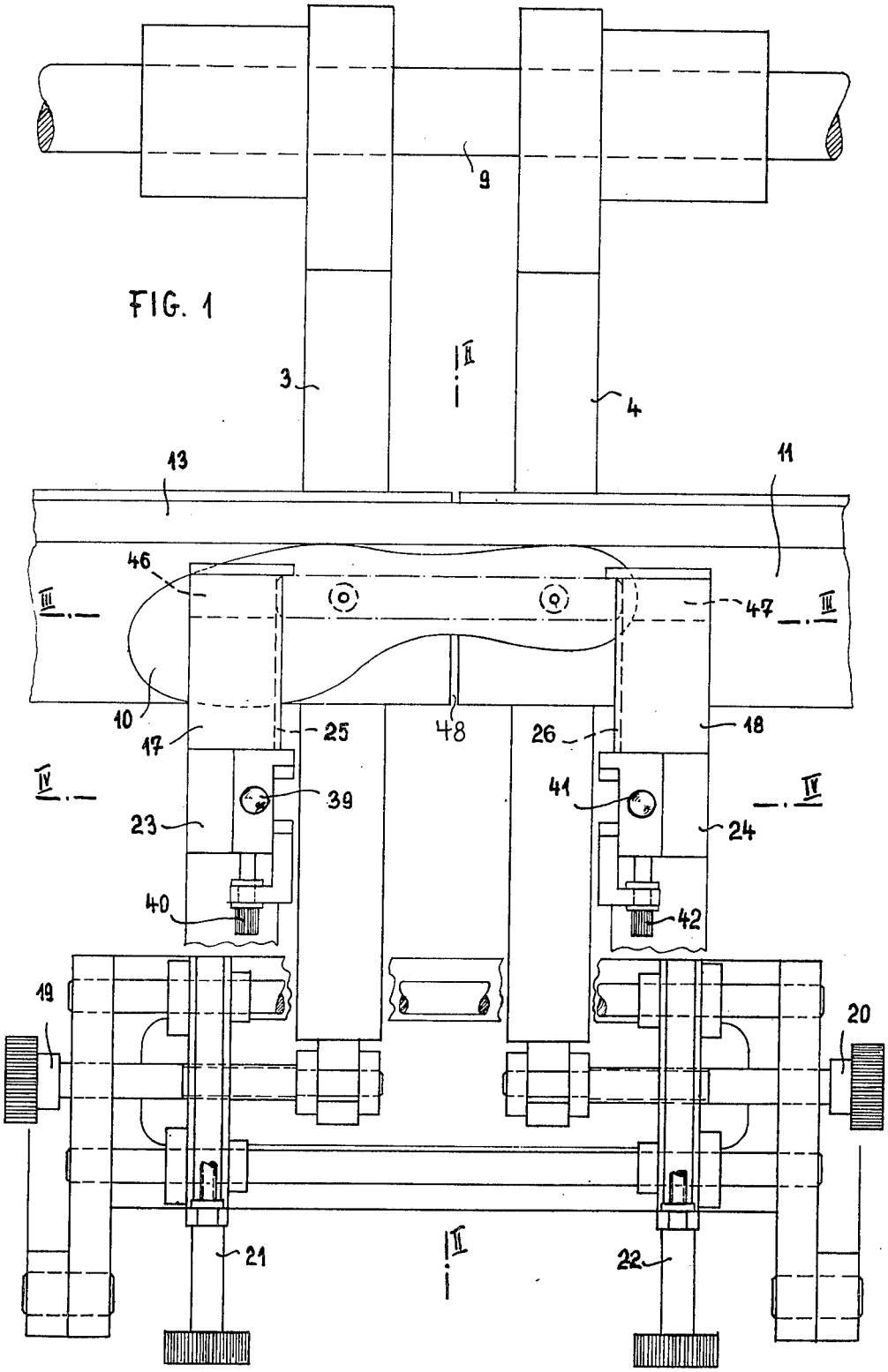
FIG. 1 is a plan view of the essential parts of the apparatus of the invention.

In the non-detailed machine shown, there are two riveting tools, a stacking and guiding means for, for example, innersoles, a storing means and guide means for rivets, and finally, a stacking and guide means for shanks or leaf springs; also two rivet punches 1 and 2, held on two upright brackets 3 and 4, respectively, are provided, the brackets 3 and 4 also carry the riveting tools 5 and 6 with the rivet catcher pegs 7 and 8. These two uprights are connected in changeably spaced position by means of the threaded shaft (FIG. 1), in any known way. Thereby, the distance between the rivet punches and the cooperating riveting tools can be adjusted to suit any desired requirements depending on the size and shapes of the innersoles and springs.

The innersole 10 from the stack magazine 12 is fed along guide way 11 (FIG. 3), in the known way, by means (not shown in detail) for moving innersoles from a stack into the working site and temporarily adjusting and fixing it in the working site. The lateral guide 13 can be either on the right or left side with respect to the direction of feeding and through simple adjusting means can be arranged to be loaded from two neighboring magazines containing right and left innersoles, respectively. The supply of individual rivets likewise is obtained by means of a known type of rivet guides 14 and 15, the internal structure of which is not shown.

The guiding of the shank 16 takes place over guide bars 17,18 and especially constructed guiding, feeding and holding means on these guide bars.

In FIG. 1, only the ends of the guide bars 17 and 18 which extend into the riveting tool area are shown. The other ends thereof have been cut away in order to be able to show the adjustment means more clearly, which permit the adjustment of the distances between bars 17 and 18 and an adjustment of the relative positions of the same with respect to the riveting tools. The usual screw adjustments 19,20 and 21,22 are shown in the cut-away portions.

Figure 2:
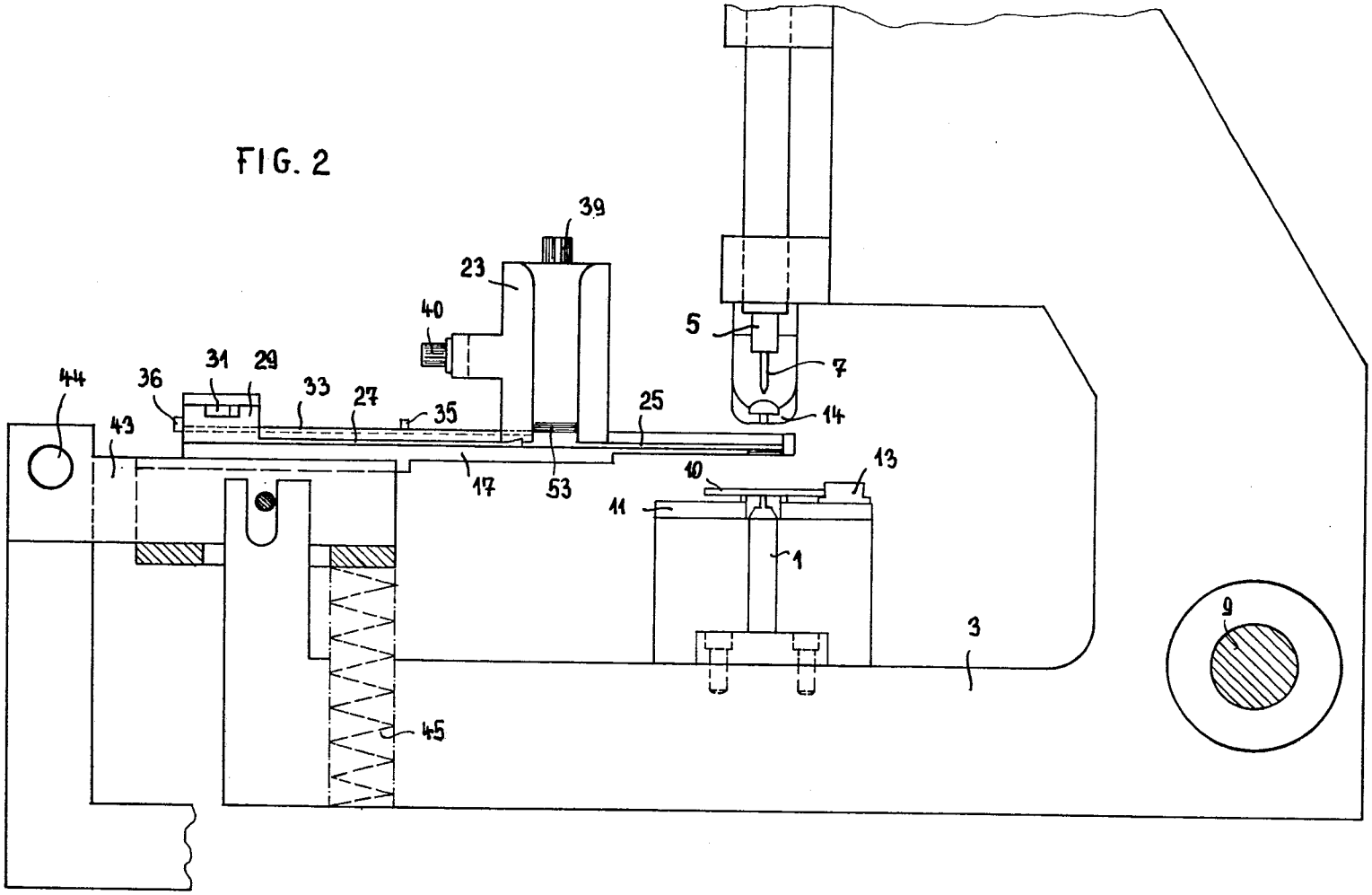
FIG. 2 is a sectional view taken on lines II — II of FIG. 1.
Figure 4:
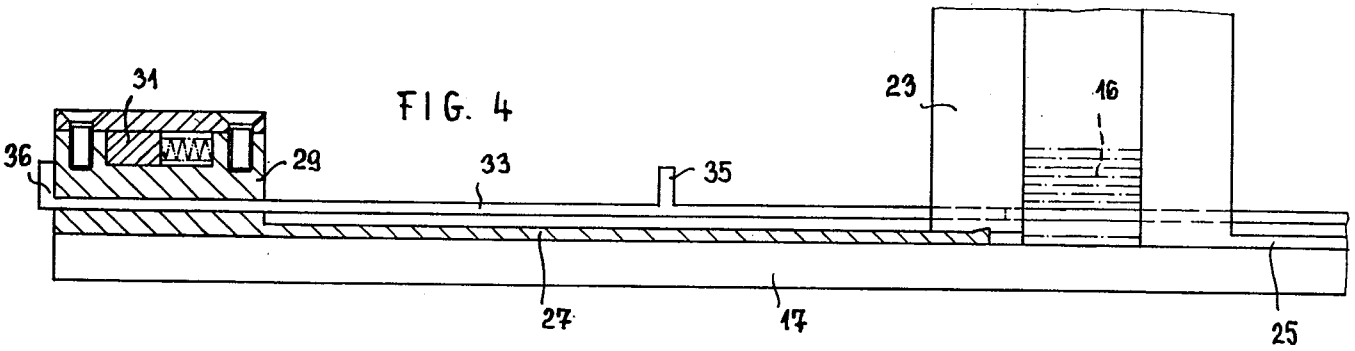
FIG. 4 is a detail sectional view along a vertical plane of a part of the apparatus.
Figure 5:
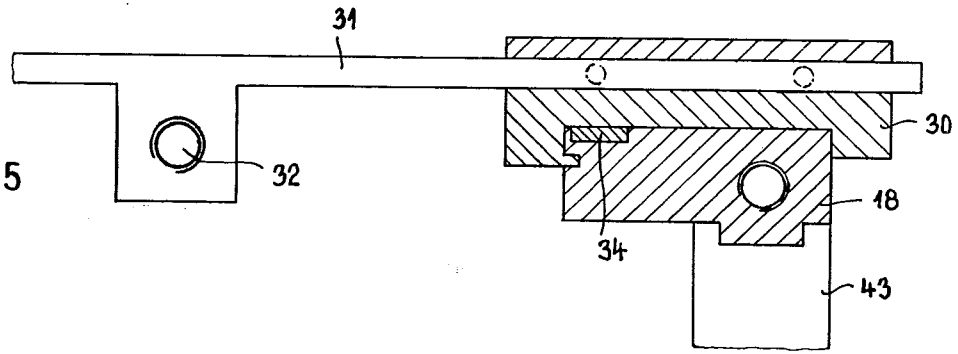
FIG. 5 is a detail view similar to FIG. 4, but taken at a different angle than in FIG. 4
Figure 6:
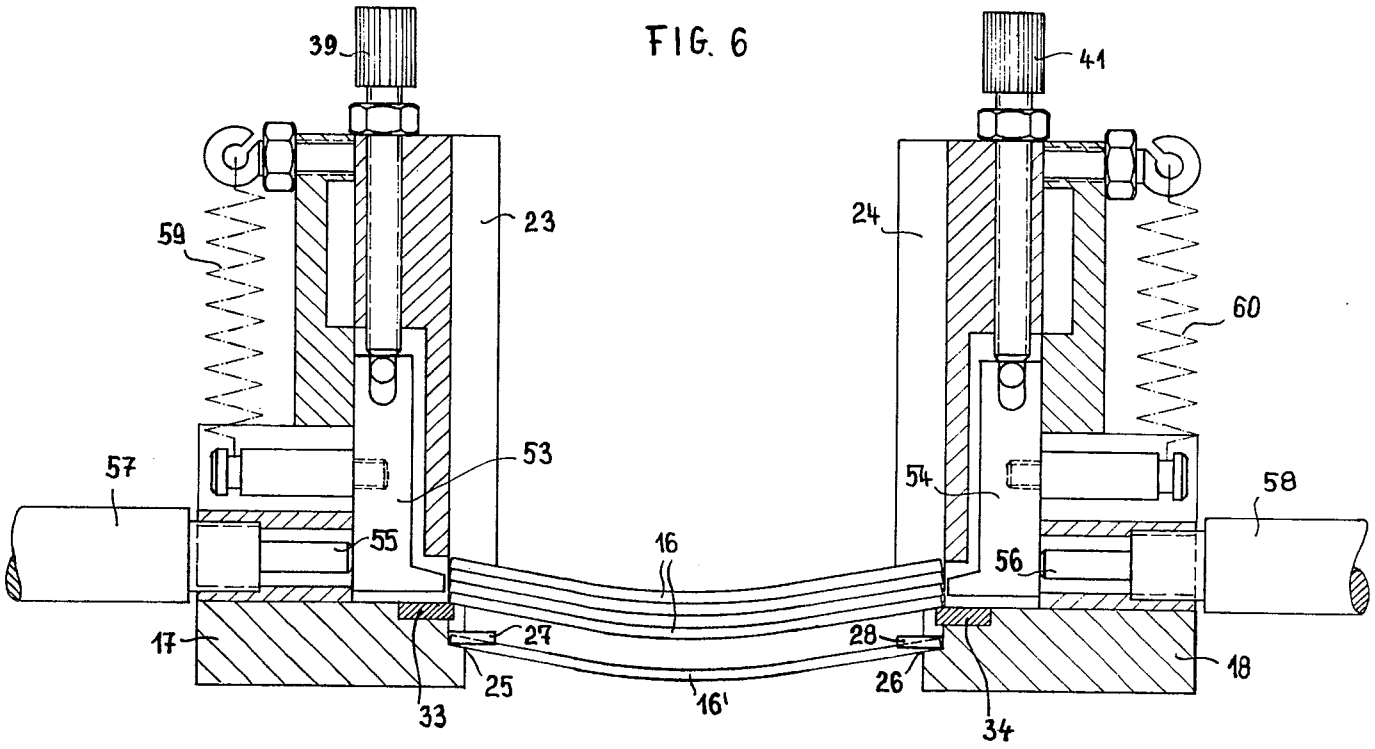
FIG. 6 is finally, a section taken on line IV — IV of FIG. 1.

On the bars 17 and 18, the spring magazines 23 and 24 for receiving the shanks are arranged. The bars 17 and 18 are provided with grooves 25,26, in which the ends of the shanks 16 can slide. The feeding movement of the shank 16 in the grooves 25,26 in the direction of the riveting tools 5,6 is obtained by sliders 27,28 (FIGS. 2,4,6), which are connected together by cross yoke 31 extending across parts 29,30 of the sliders. The cross yoke 31 is driven by a piston rod 32 (FIG. 5), which in turn is driven by a piston in a cylinder (not shown), operated and controlled pneumatically. For the delivery of a single shank 16 from the magazines 23,24, to begin the feeding movement, the bars 33,34 with upwardly projecting lugs 35,36 or 37,38 are provided which can slide in the guide part 29,30 and which will be taken along by the movement of the latter.

The magazines 23,24 are provided with adjustable means 39,40 and 41,42 (FIGS. 1 and 6) so as to be able to adapt the inner dimensions of the magazine at any time for delivering the shank for processing.

The bars 17,18 are held on a table 43, which is pivotable around a center of rotation (FIG. 2) and which is normally held in the position shown by the restoring force of spring 45 (shown schematically).

The bars 17,18 are equipped on their lower sides with leaf springs 46,47 (FIGS. 1 and 3), in the end region adjacent to the riveting tools, so that when the shank 16 reaches the end position of its feeding movement in grooves 26,27, it is retained by said leaf springs 46,47.

Figure 3:
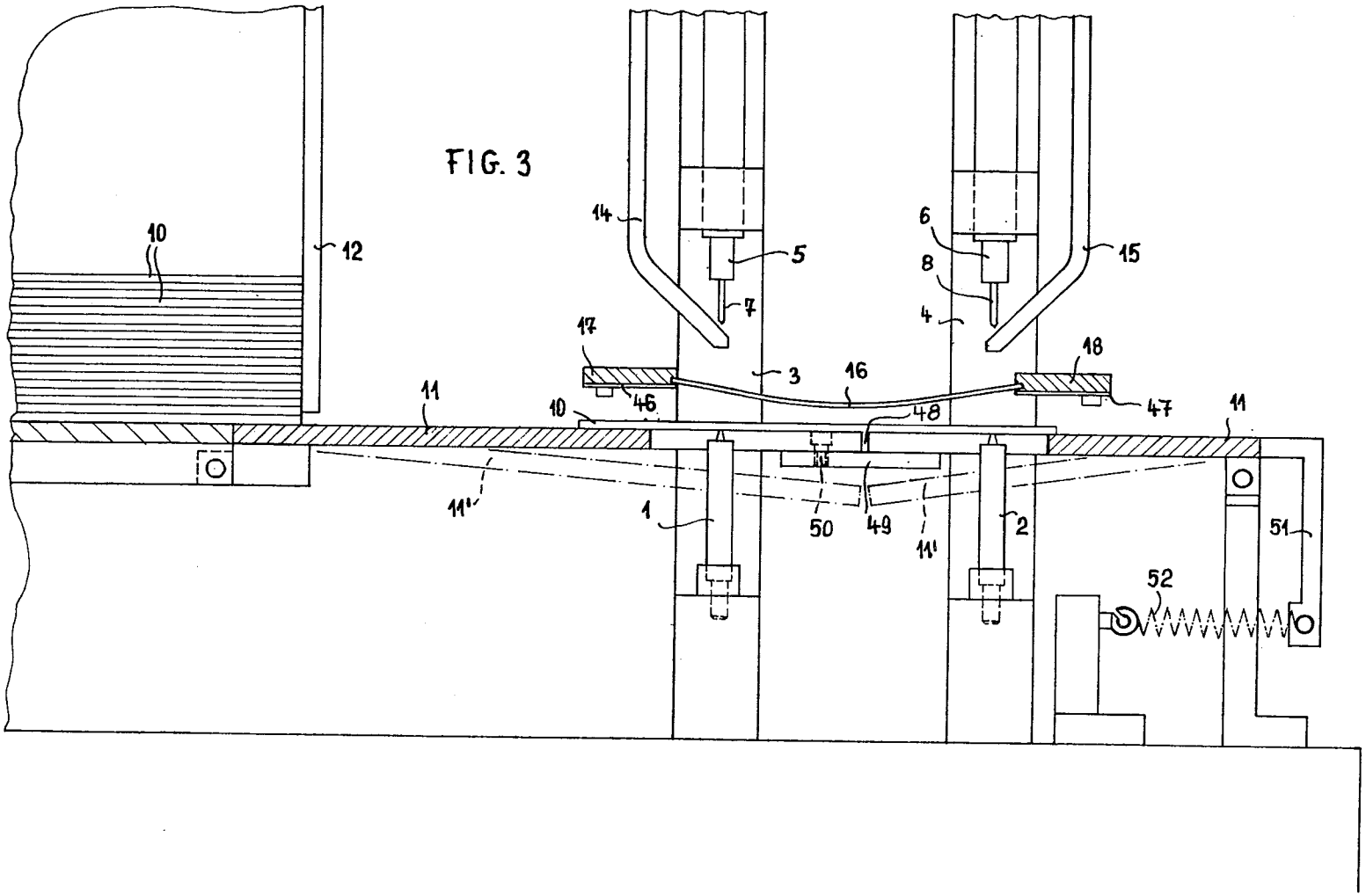
FIG. 3 is a sectional view similar to FIG. 2, but taken on line III — III of FIG. 1.

The guideway 11 for the innersole 10 is divided in the middle by a slit 48 intermediate between the two riveting tools. This slit 48 is bridged by two, mirrored-image, arranged beam of which only one, 49, is shown, the beams 49 being attached to the left hand part of the guideway 11 as shown in FIG. 3, by means of screw 50. The corresponding beam on the right hand part of guideway 11 is attached similarly to beam 49 (and not being visible has not been given a reference character). The right hand portion of guideway 11 is held in position by an arm 51 with the aid of a return spring 52 (shown only schematically). Against the force of this return spring 52 and in cooperation with the beam 49 (and the looking-glass image of beam 49), the two parts of guideway 11 can be moved to occupy the position shown by dotted lines 11'.

In the magazines 23,24, hammers 53,54 are lodged (FIG. 6) which are operated by means of piston rods 55,56, controlled by pistons in the pneumatic cylinders 57,58. The hammers are responsible, moreover, together with the bars 33,34 (FIG. 6) for the delivery, one by one, of the shanks 16, the hammers being fitted with return springs 59,60 (shown only schematically).

The feed and control means, indicated only as pneumatically controlled, as well as the feed and control means for the innersoles, rivets and riveting tools can be rendered operative in any known way by limit switches (not shown), corresponding electropneumatic control circuits, and corresponding operation control devices, for example foot control.

When an innersole has reached the operating site, and the rivets likewise have been fed to the riveting tools, a shank 16' (FIG. 6) is separated from the stack in magazines 23,24. This feeding takes place by operation of the hammers 53 and 54 which releases one shank. This shank passes into grooves 25,26 and the pushers 27,28 bring it to the end position in the operative position over the leaf springs 46,47.

When the riveting tools descend, the end regions of guides 17,18 can also pivot to a certain degree against the action the spring 45. The spring 45 and the pivoting range are obviously adjustable. A point is reached where the shank 16 is pressed downwardly by the riveting tool with its middle arch resting solidly on the innersole 10. When this definite site of the shank is reached, the latter snaps out of the leaf springs 46,47 of the holder. The riveting step is then completed by further descending of the riveting tool onto the riveting punch.

The tool returns to its initial position. The innersole with its attached shank is removed from the working site in the known way. The process can then be repeated.

I claim:

1. Apparatus for the connecting of flexible pieces such as innersoles, with shanks through riveting of the type having a stack and guide arrangement for the innersoles or flexible pieces, as well as a supply and guide arrangement for the rivets and two riveting devices for joining and riveting the two work pieces as well as a supply and guide arrangement for the shanks with a control for the release and carrying out of the different feeding and working operations, the improvement comprising a pair of magazines adapted to hold a stack of shanks therebetween, a pair of guide bars positioned below the magazines and adapted to receive a shank from the stack held within the magazines, each of said magazines containing a hammer adapted to move toward each other to release the edges of the lowermost shank held in the magazines, each of said guide bars containing a guiding groove adapted to receive the edges of released shank, a movable slider for conducting individual shanks held between said grooves of the guide bars, to an end position of said grooves in which said shank is positioned above the flexible piece to which it is to be riveted, a pair of riveting devices adjacent the end position of the grooves, each of said guide bars having a leaf spring at its end position forming the underside of the groove in that area whereby the shank in the end position in the grooves may be snapped out of said grooves, pivotally mounted table supporting the guide bars so that they may be depressed to bring the shank into contact with the flexible piece before being snapped out of said grooves, spring means biased to maintain the table in non-depressed condition.

2. Apparatus as claimed in claim 1 wherein the movable slider passes along a pair of tie bars having stops thereon.

3. Apparatus as clamed in claim 1 wherein the leaf springs at the end of said guide bars are downwardly arched at the edges.

4. Apparatus as claimed in claim 1 comprising means for mutually displacing the different holding and feeding means whereby different sizes and shapes of shanks can be accommodated.

* * * * *